US010137484B2

(12) United States Patent
Turner et al.

(10) Patent No.: US 10,137,484 B2
(45) Date of Patent: Nov. 27, 2018

(54) METHODS AND SYSTEMS FOR PASSIVATION OF REMOTE SYSTEMS BY CHEMICAL DISPLACEMENT THROUGH PRE-CHARGED CONDUITS

(71) Applicants: Douglas J. Turner, Kingwood, TX (US); Jonathan R. Dubois, Spring, TX (US); Marc S. Young, Sealy, TX (US)

(72) Inventors: Douglas J. Turner, Kingwood, TX (US); Jonathan R. Dubois, Spring, TX (US); Marc S. Young, Sealy, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 0 days.

(21) Appl. No.: 15/188,352

(22) Filed: Jun. 21, 2016

(65) Prior Publication Data

US 2017/0014874 A1 Jan. 19, 2017

Related U.S. Application Data

(60) Provisional application No. 62/193,408, filed on Jul. 16, 2015.

(51) Int. Cl.

| | |
|---|---|
| ***B08B 9/032*** | (2006.01) |
| ***F17D 5/00*** | (2006.01) |
| ***E21B 41/00*** | (2006.01) |
| ***E21B 21/06*** | (2006.01) |
| ***E21B 21/08*** | (2006.01) |

(52) U.S. Cl.

CPC ..... *B08B 9/0325* (2013.01); *E21B 21/06* (2013.01); *E21B 21/08* (2013.01); *E21B 41/0007* (2013.01); *F17D 5/00* (2013.01)

(58) Field of Classification Search

CPC ..... B08B 9/0325; F17D 5/00; E21B 41/0007; E21B 21/06; E21B 21/08

USPC ..... 137/263, 266, 597, 625.4, 599.03, 602, 137/606, 607, 599.14

See application file for complete search history.

(56) References Cited

U.S. PATENT DOCUMENTS

| | | | | |
|---|---|---|---|---|
| 3,556,218 | A | 1/1971 | Talley, Jr. et al. | |
| 3,797,516 | A * | 3/1974 | Forster et al. | F02C 9/24 137/340 |
| 4,276,904 | A * | 7/1981 | Jackson | B01J 4/02 137/599.01 |
| 4,565,207 | A * | 1/1986 | Sherrod | F17D 1/04 137/1 |
| 7,219,682 | B2 * | 5/2007 | Agnew et al. | F17C 13/084 137/1 |
| 7,721,807 | B2 | 5/2010 | Stoisits et al. | |
| 7,735,506 | B2 * | 6/2010 | Horton, III et al. | B65D 88/78 137/1 |

(Continued)

FOREIGN PATENT DOCUMENTS

| | | |
|---|---|---|
| GB | 2276218 | 9/1994 |
| WO | WO 2014/035375 | 3/2014 |

*Primary Examiner* — Kevin Lee

(74) *Attorney, Agent, or Firm* — ExxonMobil Upstream Research Company-Law Department

(57) ABSTRACT

The present techniques are directed to systems and methods for displacing a structure in a fluid handling system with a displacement fluid. A system includes a plurality of storage conduits that can hold a treatment fluid or a barrier fluid. The treatment and barrier fluids are transferred from the storage conduits by a displacement fluid using a driver.

19 Claims, 8 Drawing Sheets

(56) References Cited

U.S. PATENT DOCUMENTS

| | | | | |
|---|---|---|---|---|
| 8,430,169 | B2 * | 4/2013 | Stoisits | E21B 37/06 137/7 |
| 2003/0061820 | A1 | 4/2003 | Bishop | |
| 2006/0124300 | A1 | 6/2006 | Steiner et al. | |
| 2011/0011593 | A1 | 1/2011 | Borhaug et al. | |
| 2012/0241161 | A1 | 9/2012 | Edwards et al. | |
| 2014/0053874 | A1 | 2/2014 | Mackenzie et al. | |

* cited by examiner

36

38

40

METHODS AND SYSTEMS FOR PASSIVATION OF REMOTE SYSTEMS BY CHEMICAL DISPLACEMENT THROUGH PRE-CHARGED CONDUITS

CROSS-REFERENCE TO RELATED APPLICATION

This application claims the benefit of U.S. Provisional Application No. 62/193,408, filed Jul. 16, 2015, entitled METHODS AND SYSTEMS FOR PASSIVATION OF REMOTE SYSTEMS BY CHEMICAL DISPLACEMENT THROUGH PRE-CHARGED CONDUITS the entirety of which is incorporated by reference herein.

FIELD

The present disclosure is directed generally to systems and methods for displacing fluids from a fluid handling system. The systems and methods are useful for displacement of flow lines of a remote system. The systems and methods can be applied to displacement of hydrocarbon fluids from a hydrocarbon production system or other hydrocarbon fluid handling system.

BACKGROUND

There are numerous situations in which a fluid resident in a flow line or other structure of a fluid handling system might need to be replaced with a different fluid. In the field of hydrocarbon production, several situations might occur that require displacement of a production flow line with an "inert" fluid. These situations include but are not limited to: hydrate mitigation of a shut-in flow line; preparation for potential iceberg snag of the flow line; displacement of gelled crude during a long-term shut-in; decommissioning a flow line; repurposing a flow line; and preparation for maintenance of a flow line. In any event requiring displacement of a flow line, a looped flow line system is often utilized, particularly for offshore and/or remote applications.

An effective displacement is one that sweeps the flow line substantially free of active fluids and does not result in formation of a significant amount of hydrate or other suspended solids (i.e., an amount that results in impairment of fluid flow). High flow rates are usually required to effectively sweep the flow lines of active fluids.

One method of displacement that has been considered involves sweeping production fluids using a pig prior to charging the flow line with displacement fluid. However, offshore facilities may be constrained by the size and weight of the pig launcher and receiver. Additionally, the large surges that may be encountered from pigging may potentially overwhelm an offshore facility's inlet separation capabilities. Another consideration relates to the fact that pigging typically requires a similar-sized looped flow line system, increasing flow line costs.

Another method of displacement that has been considered involves the use of a fully inert fluid as a displacement fluid. As may be appreciated, this may be an option for seawater displacement when hydrate forming conditions are not present. One issue that may be encountered relates to the fact that, to maintain high fluid velocity in the flow line, the fluid transfer line often needs to be of comparable size. Another issue that may be encountered relates to the large quantities of chemicals often required, which can be prohibitive on offshore facilities.

Another method of displacement that has been considered involves the use of a "pill" of inert fluid prior to the introduction of a displacement fluid. As may be appreciated, to maintain adequate velocities for displacement, all pumps may require full displacement capacity. Additionally, storage space is required at the topsides facility for the inert fluid.

As such, there exists a need to address the aforementioned problems and issues. Therefore, it is desired to have a system for displacing fluids from a flow line or other structure that may be more cost-effective and efficient than conventional methods. The presently described systems and methods are useful for performing displacement operations remotely using conduits pre-charged with fluids.

SUMMARY

In one or more aspects, disclosed herein is a system for displacing fluids from a fluid handling system that includes at least one structure requiring displacement. The system for displacing fluids includes: i) a plurality of storage conduits, each storage conduit having an outlet and an inlet valve proximate an inlet; ii) an outlet manifold having a plurality of inlets, one for each outlet of the plurality of storage conduits, and a manifold outlet spaced from the plurality of inlets; iii) an outlet valve proximate the manifold outlet and connected to a flow line in fluid communication with the inlet of the at least one structure to be displaced; iv) an inlet manifold having an inlet and a plurality of outlets, each of the plurality of outlets in fluid communication with an associated inlet valve of one of the plurality of storage conduits; and v) at least one driver for transferring fluids into and out of the plurality of storage conduits and in fluid communication with the inlet manifold.

In one or more aspects, disclosed herein is a method for displacing fluids in a fluid handling system that includes at least one structure to be displaced and a plurality of storage conduits. The method includes transferring a treatment fluid from at least one of the plurality of storage conduits towards or into the structure(s) to be displaced using a driver, while charging the storage conduit(s) from which the treatment fluid is transferred with displacement fluid; transferring a barrier fluid from at least one of the plurality of storage conduits towards or into the structure(s) to be displaced using a driver, while charging the storage conduit(s) from which the barrier fluid is transferred with displacement fluid; and transferring the displacement fluid into the structure(s) to be displaced.

In one or more aspects, disclosed herein is a method for displacing active hydrocarbon fluids to shut-in a hydrocarbon production system that includes at least one structure to be displaced and a plurality of storage conduits. The method includes transferring a treatment fluid from at least one of the plurality of storage conduits towards or into the structure(s) to be displaced using at least one driver, while charging the storage conduit(s) from which the treatment fluid is transferred with displacement fluid; transferring a barrier fluid from at least one of the plurality of storage conduits towards or into the structure(s) to be displaced using the at least one driver, while charging the storage conduit(s) from which the barrier fluid is transferred with displacement fluid; and transferring the displacement fluid into the structure(s) to be displaced.

In some embodiments, the transfer of the treatment fluid continues until a desired volume of treatment fluid has been transferred towards or into the structure(s) to be displaced or all of the storage conduits containing treatment fluid have been emptied.

In some embodiments, the transfer of the barrier fluid continues until a desired volume of barrier fluid has been transferred towards or into the structure(s) to be displaced or all of the storage conduits containing barrier fluid have been emptied.

DETAILED DESCRIPTION

Figure 1:
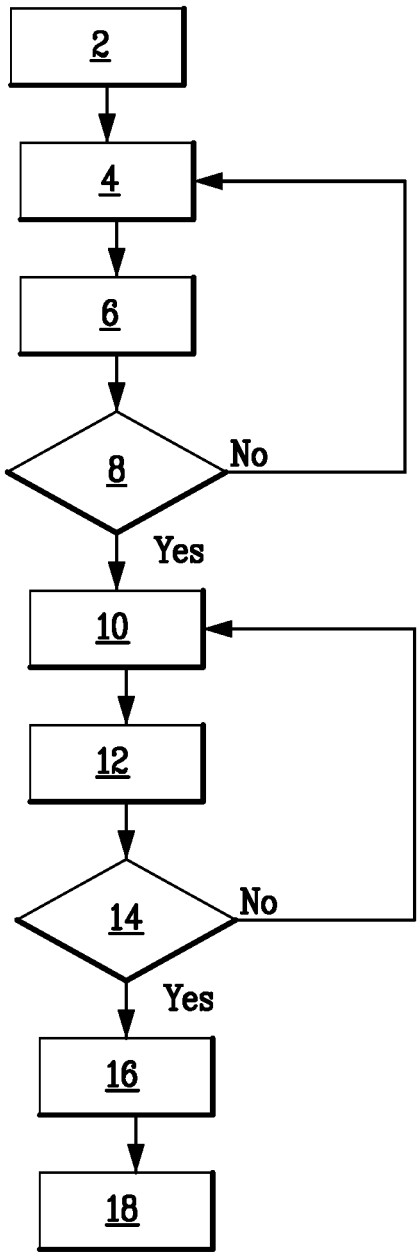
FIG. 1 presents a flow chart of the fluid displacement method.

FIGS. 1-6 provide illustrative, non-exclusive examples of methods and systems for displacing fluids from a fluid handling system, according to the present disclosure, together with elements that may include, be associated with, be operatively attached to, and/or utilize such methods and systems.

In FIGS. 1-6, like numerals denote like, or similar, structures and/or features; and each of the illustrated structures and/or features may not be discussed in detail herein with reference to the figures. Similarly, each structure and/or feature may not be explicitly labeled in the figures; and any structure and/or feature that is discussed herein with reference to the figures may be utilized with any other structure and/or feature without departing from the scope of the present disclosure.

In general, structures and/or features that are, or are likely to be, included in a given embodiment are illustrated. However, a given embodiment is not required to include all structures and/or features that are illustrated in the figures, and any suitable number of such structures and/or features may be omitted from a given embodiment without departing from the scope of the present disclosure.

It is understood that the approach disclosed herein can be applied to a variety of designs and operations even though the present description may be described in relation to displacement of hydrocarbon fluids from a hydrocarbon production system or other hydrocarbon fluid handling system.

An "active fluid" is not particularly limited and is any fluid that is normally transported in a flow line or present in a valve or other structure being displaced. In the instance of a hydrocarbon production system or other hydrocarbon fluid handling system, such as a flow line of a hydrocarbon production facility that is a production riser or a production line, or in an instance where the flow line is tree jumper connecting a wellhead to a collecting manifold, an active fluid is typically a hydrocarbon production stream.

A "displacement fluid" is a fluid that ultimately replaces the active fluid in a structure being displaced.

A fluid can be "inert" in either or both senses of "environmentally inert" and "physicochemically inert". A fluid is "environmentally inert" if it does not cause harm to the environment in which it is deployed, at least not at concentrations to which the fluid might be diluted in the environment during use. A fluid is physicochemically inert with respect to a substance if it does not react chemically on contact with that substance. Preferably, inert substances used are physicochemically inert with respect to a plurality of chemicals used in hydrocarbon production.

Whether a fluid is inert can depend on the particular conditions of use of the fluid. For example, for iceberg preparation in offshore hydrocarbon production operations, the displacement fluid is typically seawater, which is environmentally inert. For hydrate mitigation, the displacement fluid may be seawater, so long as contact of the seawater in significant amounts with production fluids is not under conditions of low temperature and/or high pressure that would result in hydrate formation. Stabilized crude oil and diesel, among others, are considered physicochemically inert fluids.

A "treatment fluid" is one that is used to prevent or mitigate some condition. A treatment fluid can be inert depending on the properties and application of the treatment fluid. A treatment fluid is typically used for its effect on a surface of a fluid handling system or in changing the physicochemical condition of fluids present in a fluid handling system. For example, in a hydrocarbon production setting, a treatment fluid might be used to remediate and/or prevent hydrate formation or to provide some other desired effect. In remediating/preventing hydrate formation, a treatment fluid would reduce or prevent association of water and gas molecules to form hydrate and/or to dissolve already formed hydrate.

A "barrier fluid" is one that is interposed between a treatment fluid and a displacement fluid. A barrier fluid is typically physicochemically inert with respect to contact with both of the treatment fluid used and the displacement fluid used.

Referring now to FIG. 1, a flow chart of a fluid displacement method is presented. At block (2), storage conduits are pre-charged with treatment and barrier fluids. In the application of the method to a hydrocarbon production system, the well(s) are shut in. At block (4), valves are arranged to open the outlet valve proximate the outlet manifold, the inlet manifold inlet valve associated with the source of displacement fluid and inlet valves of one or more storage conduits containing treatment fluid. At block (6), the displacement fluid driver is used to drive displacement fluid into the open storage conduits containing the treatment fluid so that the treatment fluid is transferred out of the storage conduits towards or into the structure to be displaced while the open storage conduits are charged (or filled) with displacement fluid. Once charged, the inlet valves of the storage conduits are closed. At block (8), the system is checked to determine if the desired volume of treatment fluid has been transferred or if all of the storage conduits containing treatment fluid have been emptied. If yes, the process proceeds to block (10). If no, the process returns to block (4) and the process continues for additional storage conduits charged with treatment fluid until the desired volume of treatment fluid has been transferred or the storage conduits are emptied of treatment fluid.

At block (10), valves are arranged to open the inlet valves of one or more storage conduits containing barrier fluid. At block (12), the displacement fluid driver is used to drive displacement fluid into the open storage conduits containing the barrier fluid so that the barrier fluid is transferred out of the storage conduits towards or into the structure to be displaced while the open storage conduits fill with displacement fluid. At block (14), the system is checked to determine if the desired volume of barrier fluid has been transferred or if all of the storage conduits containing barrier fluid have been emptied. If yes, the process proceeds to block (16). If no, the inlet valves of the charged storage conduits are closed and the process returns to block (10) and the process continues for additional storage conduits charged with barrier fluid until the desired volume of barrier fluid has been transferred or the storage conduit(s) are emptied of barrier fluid. At block (16), inlet valves of the storage conduits are opened if not already open so that storage conduits charged with displacement fluid are in fluid communication with the inlet manifold. At block (18), the displacement fluid driver is used to transfer displacement fluid through all storage conduits that are open to the outlet manifold until the structure to be displaced is full of displacement fluid. Such complete displacement of the structure may use additional displacement fluid from the source of displacement fluid.

Figure 2A:
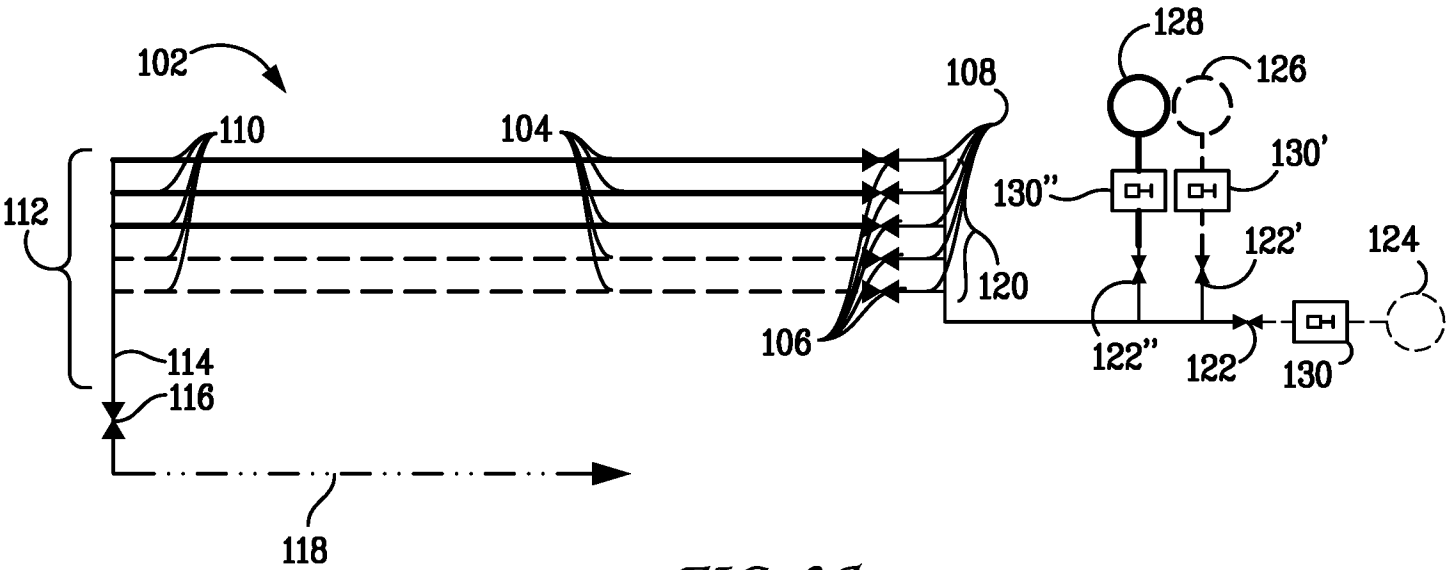
FIG. 2A illustrates an embodiment of the system in which individually configured drivers and valves are used for transferring each fluid through the system.
Figure 2B:
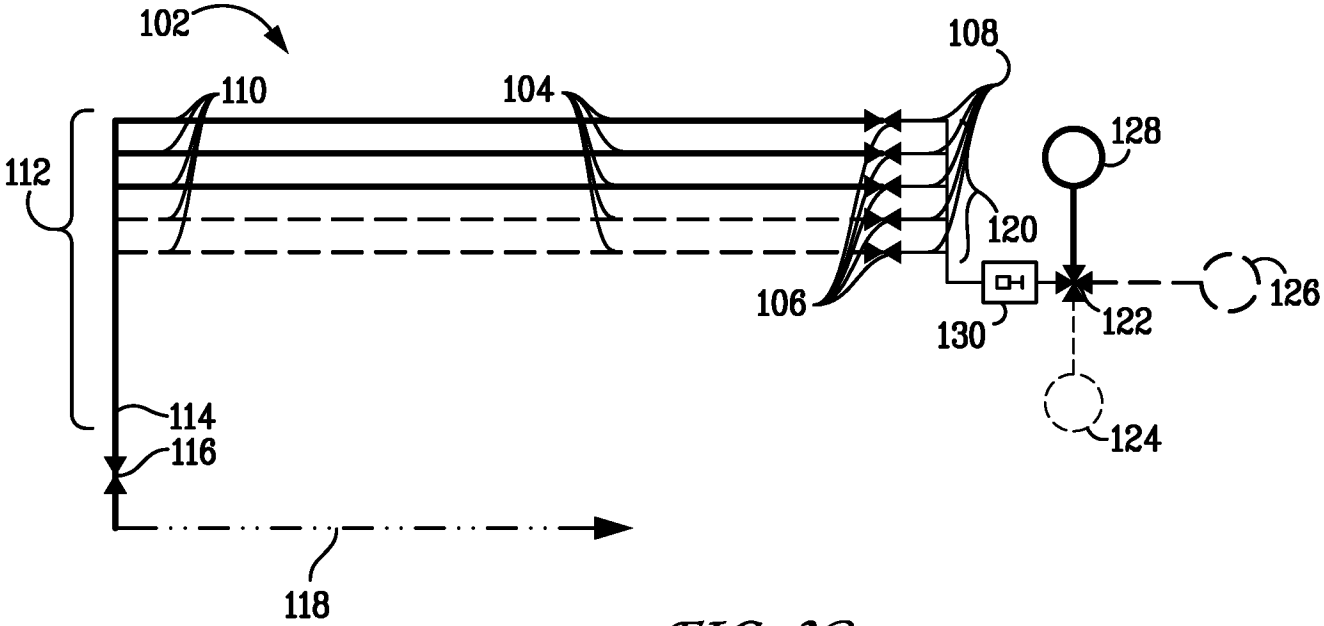
FIG. 2B illustrates an embodiment of the system in which the various fluids are transferred through the system with a single driver.
Figure 3:
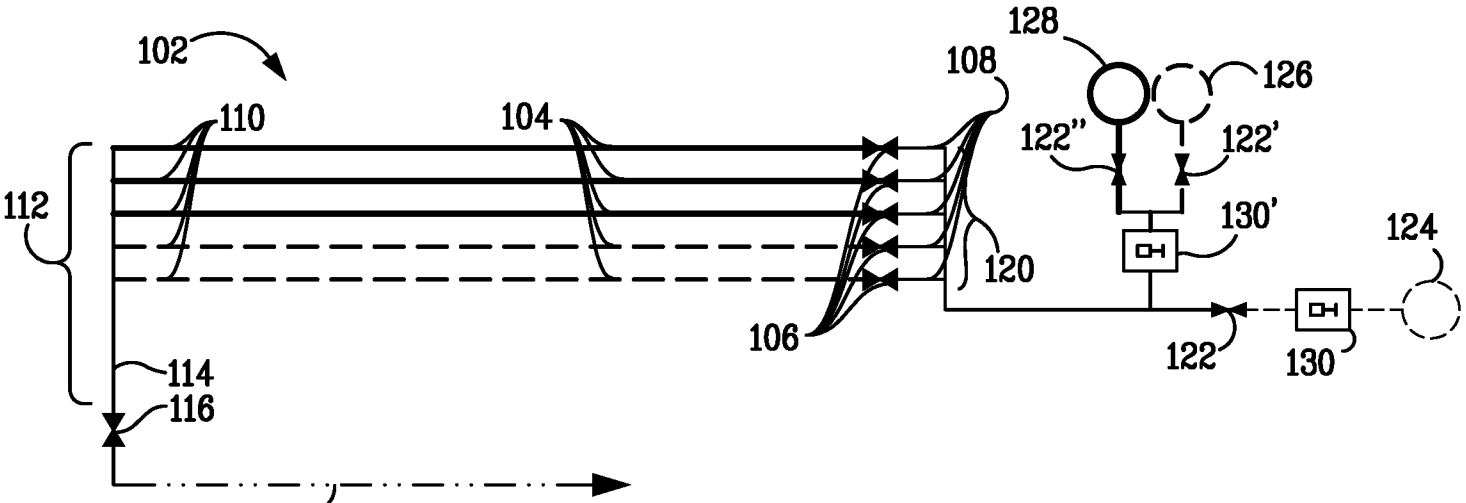
FIG. 3 illustrates an embodiment of the system in which a single pump (a first pump) is the driver of the displacement fluid, and a single pump (second pump) is the driver of both the treatment fluid and the barrier fluid.
Figure 4:
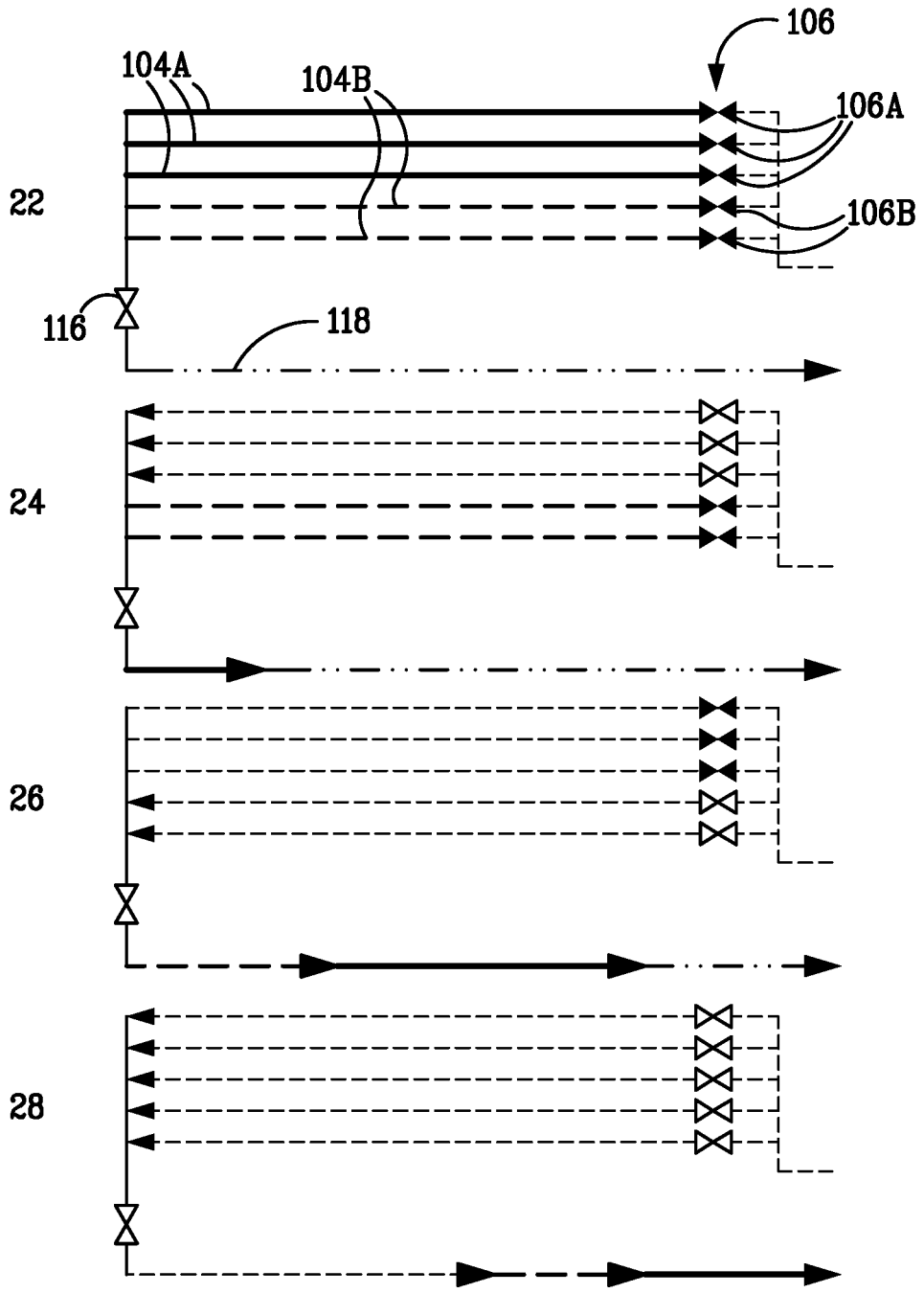
FIG. 4 illustrates an example of the sequencing of displacement using seawater as the displacement fluid.

Referring now to FIG. 2A, a system (102) is shown, which includes: i) a plurality of storage conduits (104), each storage conduit comprising tubing, piping, or a vessel having an inlet valve (106) at an inlet end (108) and joined at their outlet ends (110) by an outlet manifold (112) having a plurality of inlets, one for each outlet of the plurality of storage conduits and having a single outlet (114) spaced (distal) from the plurality of inlets; ii) an outlet valve (116) proximate the outlet of the outlet manifold and in fluid communication with the structure to be displaced (118), the structure to be displaced may be a production flow line or any other structure as described herein; iii) an inlet manifold (120) having a single inlet and a plurality of outlets, each outlet in fluid communication with an associated inlet valve of one of the plurality of storage conduits; iv) individual inlet manifold inlet valves (122, 122', 122") on each of the flow lines for receiving fluids from different storage facilities or to an alternative source of displacement fluid that may be configured to select flow from each source into the inlet manifold; and v) a plurality of drivers (130, 130', 130") (e.g., pumps) for transferring fluids into and out of the storage conduits and in fluid communication with the inlet manifold and the associated storage facility (124, 126, 128). Although the inlet valves of the storage conduits in FIG. 2A, as well as FIGS. 2B and 3-4, are depicted as two-way valves, it is understood that any suitable multi-way valve may be used for the inlet valves, such as a three-way inlet valve. The same also applies to the outlet valve and the inlet manifold inlet valves. The storage facility (128) contains treatment fluid. The storage facility (126) contains barrier fluid. The storage facility (124) contains displacement fluid. Active fluid is represented by a series of a long dash followed by two dots. Treatment fluid is represented by a solid line. Barrier fluid is represented by a series of thick dashes. Displacement fluid is represented by a series of thin dashes. Per FIG. 2B, the multiple drivers (130, 130', 130" in FIG. 2A) may be substituted with a single driver (130) (e.g., a pump) for transferring fluids into and out of the storage conduits and in fluid communication with the inlet manifold and storage facilities (124, 126, 128). Like numbered items in FIGS. 2B, 3, 4, and 6 are as described with respect to FIG. 2A. With the single driver configuration in FIG. 2B, the embodiment may feature a single, multi-way (four-way) inlet manifold inlet valve (122) or one inlet manifold inlet valve per fluid/chemical source (not shown for illustrative purposes).

Referring now to FIG. 3, an alternative embodiment of the system is shown in which treatment and barrier fluids are transferred by a shared driver (130') (e.g., a pump) and displacement fluid is transferred by a separate driver (130) (e.g., a pump) and in which separate valves are provided on the flow lines from the source of each of the treatment fluid (122"), the barrier fluid (122'), and the displacement fluid (122).

Referring now to FIG. 4, an example of the sequencing of displacement using seawater as the displacement fluid. At (22), storage conduits (104A) are precharged with treatment fluid (e.g., methanol), storage conduits (104B) are precharged with barrier fluid (e.g., diesel), and a storage facility (not shown) is precharged with displacement fluid (e.g., seawater). Structure (118) contains active fluid. At (24), inlet valves (106A) are opened and treatment fluid displacement is performed. Storage conduits (104A) initially containing the treatment fluid (methanol) are now charged with displacement fluid (seawater). Structure (118) contains active fluid ahead of the treatment fluid. Valves without shading indicate an open position and valves with shading indicate a closed position. At (26), inlet valves (106A) are closed, inlet valves (106B) opened, and barrier fluid displacement is performed. Storage conduits (104B) initially containing barrier fluid (diesel) are now charged with displacement fluid (seawater). Structure (118) contains active fluid ahead of the treatment fluid followed by the barrier fluid. At (28), inlet valves (106A) are opened and the displacement fluid is transferred through the storage conduits and into the system being displaced until sufficient volume of displacement fluid has been delivered to substantially fill the system being displaced. Structure (118) contains treatment fluid ahead of the barrier fluid followed by the displacement fluid. The barrier fluid separates the treatment fluid from the displacement fluid. The storage conduits may contain sufficient displacement fluid to completely displace the structure (118) or additional displacement fluid may be transferred from the storage facility (not shown) via the storage conduits using the driver such that the structure (118) is ultimately substantially filled with displacement fluid.

In some embodiments, the system may comprise: i) a plurality of storage conduits, each storage conduit having an outlet and an inlet valve proximate an inlet; ii) an outlet manifold having a plurality of inlets, one for each outlet of the plurality of storage conduits, and a single outlet spaced from the plurality of inlets; iii) an outlet valve proximate the outlet of the outlet manifold and connected to a flow line in fluid communication with the inlet of the structure to be displaced; iv) an inlet manifold having a single inlet and a plurality of outlets, each outlet in fluid communication with an associated inlet valve of one of the plurality of storage conduits; v) a single inlet manifold inlet valve in fluid communication with a source of displacement fluid, a source of treatment fluid, a source of barrier fluid, and the inlet of the inlet manifold; vi) a displacement fluid driver for transferring (moving) displacement fluids, treatment fluids and barrier fluids into and out of the storage conduits. In other embodiments, the single inlet manifold inlet valve may be substituted by a plurality of valves placed in line between the sources of the treatment fluid, the barrier fluid and/or the displacement fluid and the displacement fluid driver; the plurality of valves being configured to deliver one fluid at a time to the driver. In other embodiments, one or more additional drivers may be used to transfer treatment fluid and barrier fluid into the storage conduits to recharge the storage conduits while the displacement fluid driver is used to transfer displacement fluid. In some embodiments, a plurality of drivers may be used to transfer a single fluid (e.g., displacement fluid, treatment fluid, or barrier fluid).

A system may also include one or more dedicated service drivers for transferring particular chemicals from a storage facility located separate from the system into the inlet manifold. The separate storage facility may be remote from the displacement system, e.g., on a floating platform in instances when the displacement system is located subsea.

In some embodiments, the hydrocarbon production system may be a single subsea well or collection of subsea wells. The hydrocarbon production system may comprise a production flow line leading from a subsea well or wells to a surface facility, either on land or on a floating facility. In such embodiments, the storage conduits of the fluid displacement system may be contained within a bundle, such as an umbilical, within the hydrocarbon production system.

In some embodiments, the hydrocarbon production system may be a wholly land-based production system. The hydrocarbon production system may comprise a production flow line leading from a land-based well or wells to a separator facility. In such embodiments, the storage conduits of the fluid displacement system may be contained within a bundle within the hydrocarbon production system.

In any of the embodiments, the production flow line to be displaced in the hydrocarbon production system may additionally include a riser.

In any of the embodiments, structures to be displaced may include one or more flow lines, pumps, vessels, valves, and/or separators in fluid communication with the fluid displacement system. The system may include a plurality of structures to be displaced, such as one or more pumps, vessels, valves, and/or separators in fluid communication with a production flow line to be displaced.

In any of the embodiments, the fluid handling system and fluid displacement system may be located remote from a control facility and the valves of the system configured for remote operation from the control facility.

In any of the embodiments, one or more valves controlling the transfer of fluids through the system are configured for remote control via hydraulic, electrical, or optical signal. In embodiments where the system disclosed herein is located below the surface of a body of water (subsea), the valves are able to be controlled remotely from the surface.

In any of the embodiments relating to hydrocarbon production, the treatment fluid may be any suitable hydrate inhibitor, for example, the treatment fluid may be selected from methanol, ethanol, ethylene glycol, diethylene glycol, triethylene glycol, and any combinations thereof. The barrier fluid may be selected from diesel, stabilized crude oil, nitrogen, argon, and any combinations thereof.

In any of the embodiments, the displacement fluid that displaces the storage conduits may be seawater and the source of the displacement fluid may be an ocean.

In any of the embodiments, the displacement fluid driver may be a single pump, compressor, or pressurized vessel. In other embodiments, a plurality of displacement fluid drivers may be used in supplying the displacement fluid.

In some embodiments, the fluid displacement system may comprise: i) a plurality of storage conduits, each storage conduit having an outlet and an inlet valve proximate an inlet, at least one of the plurality of storage conduits being charged with a treatment fluid and at least one of the plurality of storage conduits being charged with a barrier fluid; ii) an outlet manifold having a plurality of inlets, one for each outlet of the plurality of storage conduits, and a single outlet spaced from the plurality of inlets; iii) an outlet valve proximate the outlet of the outlet manifold and connected to a flow line in fluid communication with the inlet of a structure to be displaced; iv) an inlet manifold having a single inlet and a plurality of outlets, each outlet in fluid communication with an associated inlet valve of one of the plurality of storage conduits; v) a displacement fluid inlet manifold inlet valve (a first inlet manifold inlet valve) having an inlet in fluid communication with a source of displacement fluid and having an outlet in fluid communication with the inlet manifold; vi) a treatment fluid inlet manifold inlet valve (a second inlet manifold inlet valve) having an inlet in fluid communication with a source of treatment fluid and having an outlet in fluid communication with the inlet manifold; vii) a barrier fluid inlet manifold inlet valve (a third inlet manifold inlet valve) having an inlet in fluid communication with a source of barrier fluid and having an outlet in fluid communication with the inlet manifold; viii) a displacement fluid driver for transferring displacement fluids into and out of the plurality of storage conduits; and vii) one or more additional drivers for transferring treatment fluid and barrier fluid into the storage conduits.

In any of the embodiments, the method may comprise: a) opening the inlet valve of at least one of the storage conduits containing the treatment fluid, opening the outlet valve proximate the outlet manifold, and opening the inlet manifold inlet valve associated with the source of displacement fluid; b) transferring the treatment fluid out of the storage conduit(s) towards or into the structure to be displaced using the associated driver, and at the same time charging (filling) the storage conduit(s) from which the treatment fluid is transferred with displacement fluid from the inlet manifold until such storage conduit(s) are charged with displacement fluid; c) closing the inlet valve of each of the storage conduit(s) charged with displacement fluid; d) if necessary, repeating steps a), b), and c) until a desired volume of treatment fluid has been transferred out of the storage conduit(s) towards or into the structure to be displaced; e) opening the inlet valve of at least one of the storage conduit(s) charged with the barrier fluid; f) transferring the barrier fluid out of the storage conduit(s) towards or into the structure to be displaced using the associated driver, and at the same time charging the storage conduit(s) from which the barrier fluid is transferred with displacement fluid from the inlet manifold until the storage conduit(s) are charged with displacement fluid; g) optionally closing the storage conduit(s) previously containing barrier fluid; h) if necessary, repeating steps e), f) and g) until a desired volume of barrier fluid has been transferred out of the storage conduits towards or into the structure to be displaced; g) opening the inlet valves of all storage conduits that have been charged with displacement fluid, if not already open, and transferring the displacement fluid into the structure to be displaced until displacement fluid fills the structure to be displaced.

A desired volume of a particular fluid to be delivered to the structure(s) being displaced may be the total volume of all of the storage conduits charged with the fluid being delivered. However, it is contemplated that the number of storage conduits containing the treatment fluid and/or the barrier fluid may be such that the sum of their volumes is greater than that to be delivered. In such embodiments, it is within the scope of the present disclosure that the volume delivered of the treatment fluid and/or the barrier fluid is the volume included by a number of storage conduits less than all of such storage conduits containing the treatment fluid and/or barrier fluid being delivered. However, the entire volume of any particular storage conduit is delivered in performing the method. It is also contemplated that the number of storage conduits containing displacement fluid may be such that the sum of their volumes is less than that to be delivered to fully displace the structure(s). In such embodiments, it is within the scope of the present disclosure that additional volumes of displacement fluid may be delivered from the source containing the displacement fluid (e.g., a displacement fluid storage facility) via the storage conduits charged with the displacement fluid using the associated driver.

In some embodiments, live, active hydrocarbon fluids are displaced from at least one production flow line to shut-in a hydrocarbon production system. In such embodiments, a fluid displacement system may comprise: i) a plurality of storage conduits, each storage conduit having an outlet and an inlet valve proximate an inlet, at least one of the plurality of storage conduits being charged with a treatment fluid and at least one of the plurality of storage conduits being charged with a barrier fluid; ii) an outlet manifold having a plurality of inlets, one for each outlet of the plurality of storage conduits and a single outlet spaced from the plurality of inlets; iii) an outlet valve proximate the outlet of the outlet manifold and connected to a flow line in fluid communication with the inlet of the production flow line to be displaced; iv) an inlet manifold having a single inlet and a plurality of outlets, each outlet in fluid communication with an associated inlet valve of one of the plurality of storage conduits; v) an inlet manifold inlet valve having an inlet in fluid communication with a source of displacement fluid, and optionally, to one or more sources of treatment fluid and/or barrier fluid from another storage facility and having an outlet in fluid communication with the inlet manifold; and v) one or more drivers for transferring fluids into and out of the plurality of storage conduits. In such embodiments, the method may comprise: a) opening the inlet valve of at least one of the storage conduits containing the treatment fluid, opening the outlet valve proximate the outlet manifold, and opening the inlet manifold inlet valve associated with the source of displacement fluid; b) transferring the treatment fluid out of the storage conduit(s) towards or into the production flow line and any other structures to be displaced using the driver associated with the source of displacement fluid, and at the same time charging the storage conduit from which the treatment fluid is transferred with displacement fluid from the inlet manifold until such storage conduit is charged with displacement fluid, then closing the inlet valve of the storage conduit(s); c) if necessary, repeating steps a) and b) until a desired volume of treatment fluid has been transferred out of the storage conduit(s) towards or into the production flow line and any other structures to be displaced; d) opening the inlet valve of at least one storage conduit charged with the barrier fluid; e) transferring the barrier fluid out of the storage conduit(s) towards or into the production flow line and any other structures to be displaced using the driver associated with the source of displacement fluid, and at the same time charging the storage conduit from which the barrier fluid is transferred with displacement fluid from the inlet manifold until the storage conduit is charged with displacement fluid, then optionally closing the inlet valve of the storage conduit(s); f) if necessary, repeating steps d) and e) until a desired volume of barrier fluid has been transferred out of the storage conduit(s) towards or into the production flow line and any other structures to be displaced; g) opening the inlet valves of all storage conduits that have been charged with displacement fluid, if not already open, and transferring the displacement fluid into the production flow line and any other structures to be displaced (with the treatment fluid and barrier fluid being transferred ahead of the displacement fluid) until displacement fluid substantially fills the production flow line and any other structures to be displaced.

In any of the embodiments, the method may further comprise recharging the storage conduits with treatment fluid or barrier fluid. In some embodiments, the storage conduits to be recharged with treatment fluid may be recharged by: i) switching or configuring the single inlet manifold inlet valve such that treatment fluid can be transferred into the storage conduit(s) from the source of treatment fluid (e.g., a treatment fluid storage facility) and closing the outlet valve proximate the outlet manifold if not already in the closed position; ii) switching or configuring the inlet valve to at least one of the storage conduits to be recharged such that the storage conduit is in fluid communication with the inlet manifold if not already in the desired position; iv) switching or configuring the inlet valve, if using a multi-way valve, or a separate bypass valve or other mechanism located proximate the inlet valve, of at least one of another of the storage conduits to be recharged with treatment fluid such that the storage conduit is in fluid communication with a return flow line to allow the displacement fluid to drain therefrom as the treatment fluid displaces the displacement fluid within the storage conduit; v) using the displacement fluid driver or a dedicated treatment fluid driver to transfer the treatment fluid into the storage conduits; vi) closing the inlet valve or the bypass valve or other mechanism once the displacement fluid has been removed from the conduit; and vii) repeating steps iv), v), and vi) as necessary to recharge all the storage conduits that are to contain treatment fluid; and viii) after recharging the treatment fluid storage conduits, the valves in the open position may be returned to the fully closed position.

In some embodiments, the storage conduits to be recharged with barrier fluid may be recharged by: i) switching or configuring the single inlet manifold inlet valve such that barrier fluid can be transferred into the storage conduit(s) from the source of barrier fluid (e.g., a barrier fluid storage facility); ii) switching or configuring the inlet valve to at least one of the storage conduits to be recharged with the barrier fluid such that the storage conduit is in fluid communication with the inlet manifold; iii) switching or configuring the inlet valve, if using a multi-way valve, or separate a bypass valve or other mechanism proximate the inlet valve, of at least one of another of the storage conduits to be recharged with barrier fluid such that the storage conduit is in fluid communication with a return flow line to allow the displacement fluid to drain therefrom as the barrier fluid displaces the displacement fluid within the storage conduit; iv) using the displacement driver, the treatment fluid driver, or a dedicated barrier fluid driver to transfer the barrier fluid into the storage conduits; v) closing the inlet valve or the bypass valve or other mechanism once the displacement fluid has been removed from the conduit; vi) repeating steps iii), iv), and v) as necessary to recharge all the storage conduits that are to contain barrier fluid; and vii) after recharging the storage conduits, the valves in the open position may be returned to the fully closed position.

In other embodiments in which the storage conduits are recharged, the storage conduits to be charged with treatment fluid may be recharged by: i) closing the inlet manifold inlet valve associated with the source of displacement fluid (e.g., the first inlet manifold inlet valve) and the outlet valve proximate the outlet manifold if not already in the closed position; ii) opening the inlet manifold inlet valve associated with the source of treatment fluid (e.g., the second inlet manifold inlet valve); iii) switching or configuring the inlet valve to at least one of the storage conduits to be recharged such that the storage conduit is in fluid communication with the inlet manifold if not already in the desired position; iv) switching or configuring the inlet valve, if using a multi-way valve, or a separate bypass valve or other mechanism located proximate the inlet valve, of at least one of another of the storage conduits to be recharged with treatment fluid, such that the storage conduit is in fluid communication with a return flow line to allow the displacement fluid to drain therefrom as the treatment fluid displaces the displacement fluid within the storage conduit; v) using the displacement fluid driver or a dedicated treatment fluid driver to transfer the treatment fluid into the storage conduits; vi) closing the inlet valve or the bypass valve or other mechanism once the displacement fluid has been removed from the conduit; vii) repeating steps iv), v), and vi) as necessary to recharge all the storage conduits that are to contain treatment fluid. The storage conduits to be recharged with barrier fluid may be recharged by: i) closing the inlet manifold inlet valve associated with the treatment fluid (e.g., the second inlet manifold inlet valve); ii) opening the inlet manifold inlet valve associated with the source of the barrier fluid (e.g., the third inlet manifold inlet valve); iii) switching or configuring the inlet valve to at least one of the storage conduits to be recharged with barrier fluid such that the storage conduit is in fluid communication with the inlet manifold; iv) switching or configuring an inlet valve, if using a multi-way valve, or a separate bypass valve or other mechanism located proximate the inlet valve, of at least one of another of the storage conduits to be recharged with barrier fluid such that the storage conduit is in fluid communication with a return flow line to allow the displacement fluid to drain therefrom as the barrier fluid displaces the displacement fluid within the storage conduit; v) using the displacement fluid driver, the treatment fluid driver, or a dedicated barrier fluid driver to transfer the barrier fluid into the storage conduits; vi) closing the inlet valve or the bypass valve or other mechanism once the displacement fluid has been removed from the conduit; vii) repeating steps iv), v), and vi) as necessary to recharge all the storage conduits that are to contain barrier fluid; and viii) after recharging the storage conduits, the valves in the open position may be returned to the fully closed position.

The treatment fluid may be recharged into the storage conduits originally containing treatment fluid or to other storage conduits. The barrier fluid may be recharged into the storage conduits originally containing barrier fluid or to other storage conduits. The barrier fluid may be recharged before the treatment fluid. The displacement fluid, treatment fluid, and/or barrier fluid may be the same or different from the fluid previously used.

In the embodiments using a separate bypass valve configuration to recharge the storage conduits, the recharging may additionally include first opening the bypass valve or other mechanism of the at least one storage conduit to be recharged with the inlet valve in the closed position, opening the inlet valve of the at least one of another of the storage conduits to be recharged with the bypass valve or other mechanism in the closed position, and transferring treatment fluid or barrier fluid, depending on the fluid to be recharged, into the storage conduit(s) with the open inlet valve such that the fluid to be recharged is transferred past the closed bypass valve or other mechanism and displacement fluid drains from the open bypass valve or other mechanism. The bypass valve or other mechanism of the at least one storage conduit is then closed and the inlet valve opened. The bypass valve or other mechanism is opened on the at least one of another of the storage conduits and the inlet valve is closed. This additional process may be implemented if it is desired to completely remove the displacement fluid from the storage conduits (e.g., between the inlet manifold and the junction of the return flow line with the at least one of another of the storage conduits).

In any of the embodiments, a driver may be a pump, compressor, or pressurized vessel. The system may contain a plurality of drivers, such as one or more pumps, compressors, and/or pressurized vessels, to supply the treatment, barrier, and/or displacement fluid.

In some embodiments, the valves are configured for remote control from a location separate (or remote) from the location of the system disclosed herein. For example, the system may be located on a seafloor, and operated from a floating platform. Remote control may be applied electronically, hydraulically, or by optical signaling through a fiber optic cable.

In some embodiments, the treatment fluid may be selected from the group consisting of methanol, ethanol, ethylene glycol, diethylene glycol, and triethylene glycol; the barrier fluid may be selected from the group consisting of diesel, stabilized crude oil, nitrogen, and argon; and the displacement fluid may be seawater.

In some embodiments, the system is a subsea hydrocarbon production system comprising the above-described system, in any of its embodiments.

In some embodiments, the method may be for displacing live, active hydrocarbon fluids to shut-in a hydrocarbon production system, the hydrocarbon production system including at least one production flow line which also includes a riser (PFR) leading from a subsea wellhead and/or other structures located below the surface of a body of water (subsea) from which active hydrocarbon fluids are to be displaced to the surface facility. This embodiment may utilize the fluid displacement systems and methods as described herein In embodiments where the displacement fluid is seawater, the source of displacement fluid may be the ocean. When this is the case, the inlet into the system from the source of seawater includes at least a filter for removing large objects, e.g., plants and any debris, from the seawater. The filter should remove any objects of such size that they might impede fluid flow in the displacement system and the hydrocarbon production system to which it is connected.

In some embodiments, the storage conduits may take the form of linear tubes or coiled tubes. Alternatively, the storage conduits may be vessels having a smaller aspect ratio (that is, having an appearance more like a tank than like a tube).

Generally, the components of the system are located off of the main production (MP) facility, i.e., away from the termination of the production flow line where a separator or hydrocarbon collection and storage facility is located. The storage conduits may be located subsea, on the seafloor, buried on land or shallow water, or buried in the seabed. In some embodiments, the storage conduits and inlet manifold inlet valve, or the plurality of inlet manifold inlet valves, are located on the seafloor, particularly for remote offshore applications.

A "driver" is used to transfer fluids through the system. In some embodiments, a driver that is a pump is included in the system and is used for all fluid transfer as disclosed herein. In some embodiments, the driver may be a pressurized vessel or a compressor that is used to force fluids through the system.

In instances where a pump may be used as a driver, the pump may be connected to the system at any position along the flow line upstream of the inlet manifold such that it can push (transfer) fluid into the inlet valves of the storage conduits.

Alternatively, the driver may be at least one pressurized vessel or compressor in fluid communication with one or more of the input flow lines by which displacement, treatment, or barrier fluids, or other chemicals, are introduced into the inlet manifold. This arrangement is configured for control by valves so that each of seawater and the various fluids can be pushed (transferred) through the entire system in a desired order.

A benefit of the systems and methods disclosed herein relates to preservation of the environment, in particular the structure contents to be discharged would be environmentally, physicochemically, or otherwise inactive.

In the systems and methods disclosed herein, active fluids to be displaced, as well as treatment fluids and barrier fluids used in the method, may be drained from the system at the end of the structure being displaced. In instances where the structure is a part of a hydrocarbon production system, the fluids may be drained at a surface facility at the termination of a production flow line, for example, a riser. Thus, all of the displaced fluids can be recovered from the flow lines at a main platform or other central facility.

As disclosed herein, in a recharging phase that uses seawater as the displacement fluid, seawater occupying the storage conduits may be drained via a flow line taking return flow from a storage conduit away from the storage conduit.

The volume of the storage conduits should be such that the treatment and barrier fluids provide sufficient separation between active fluids and displacement fluids to prevent a reaction. An example would be providing sufficient methanol to prevent hydrate formation initiated by cooling fluids, followed by sufficient diesel to prevent significant losses of the methanol by dissolution into the displacement fluid. These volumes will be application specific.

The fluid velocity caused by the driver should be sufficient to sweep the active fluid from the structure in the system to be displaced without significant fluid mixing or bypass. Significant fluid mixing or bypass would be mixing such that the active fluid would contact the displacement fluid to cause a reaction that would debilitate the displacement or restart procedure. This velocity depends on fluids and systems, but is typically on the order of >1 meter per second (m/s). Fluid velocity during the displacement steps should be optimized to provide as short a time as possible for the displacement operation; that is, faster flow rates rather than slower flow rates.

Example

Seawater Displacement of an Arctic Single Line Tieback

Impact of icebergs on an umbilical and/or production flow line is a potential risk in arctic and subarctic offshore areas. Upon determination of impending iceberg contact with the production flow line, the production fluids are displaced with injection seawater. This operation is performed through five 1.5-inch umbilical service lines (USL), of which three service lines are pre-charged with methanol (treatment fluid) and two service lines are pre-charged with diesel (barrier fluid). All fluids are displaced to the production separator on the host facility. The maximum rate of displacement seawater is estimated to be 67 cubic meters per hour ($m^3$/hr) (10.1 thousand barrels per day (kbpd)) when flowing through all five displacement lines.

Displacement Operation:

The umbilical service lines will ordinarily be shut-in with pre-charged 30 cubic meters ($m^3$) of methanol in three lines and 20 $m^3$ of diesel in two lines. To displace the production flow line with seawater, the following sequence of operations, which is illustrated in FIG. 4, should be performed:

The production wells should be shut-in according to the light touch procedures.

The production flow line (118) would be depressurized back to the platform.

The subsea outlet valve (116) in fluid communication with the production flow line ((118), located proximate the subsea outlet manifold) would then be opened.

The three inlet valves (106A) connecting the methanol USLs (storage conduits) to the source of seawater displacement fluid are then opened and 30 $m^3$ of seawater would be injected (transferred) into these lines (for approximately 48 minutes at ~43 $m^3$/hr), displacing the methanol into the production flow line (118) using the seawater displacement pump until the three methanol USLs are charged with seawater.

After 30 $m^3$ of seawater have been injected into the umbilical, the inlet valve arrangement would be switched so that the three methanol USLs are closed and the inlet valves (106B) to the two diesel USLs are open to the source of seawater displacement fluid. 20 $m^3$ of seawater would then be injected (transferred) into the diesel USLs (for approximately 50 minutes at 24 $m^3$/hr), displacing the diesel into the production flow line (118) using the seawater displacement pump until the two diesel USLs are charged with seawater.

Following displacement of the diesel from the USLs, the three methanol USLs inlet valves are reopened, permitting seawater displacement at a higher rate through all five USLs.

Seawater will continue to be injected until approximately 300 $m^3$ have been injected. This will result in approximately two full displacements of the production flow line volume to ensure complete production flow line content displacement. This operation would take approximately 4.5 hours to complete at a final displacement rate of 67 $m^3$/hr (10.1 kbpd). The total operation would take approximately 6.5 hours to complete.

Following seawater displacement, the production flow line and umbilical service lines are isolated at topsides and at the subsea outlet valve in fluid communication with the production flow line ((118), located proximate the subsea outlet manifold).

Figure 5:
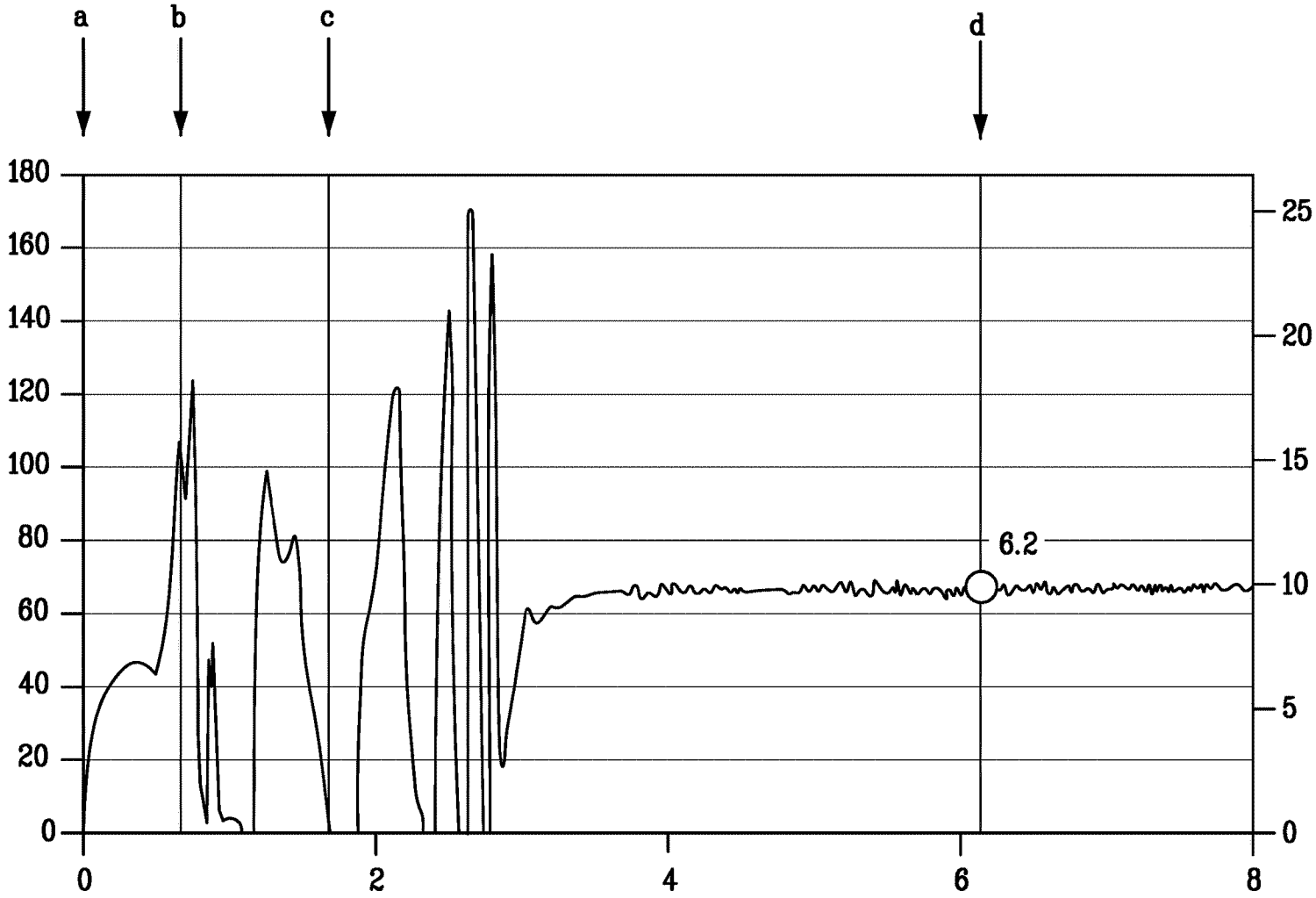
FIG. 5 provides data on surge rate during the seawater displacement operation in the provided Example.
Figure 6A:
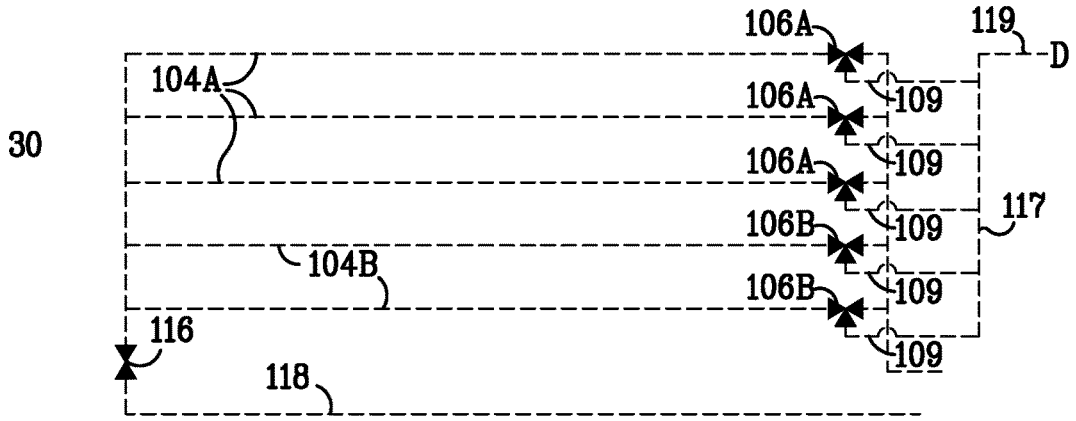
FIG. 6A-6F illustrates an example of a sequence for recharging the storage conduits.
Figure 6B:
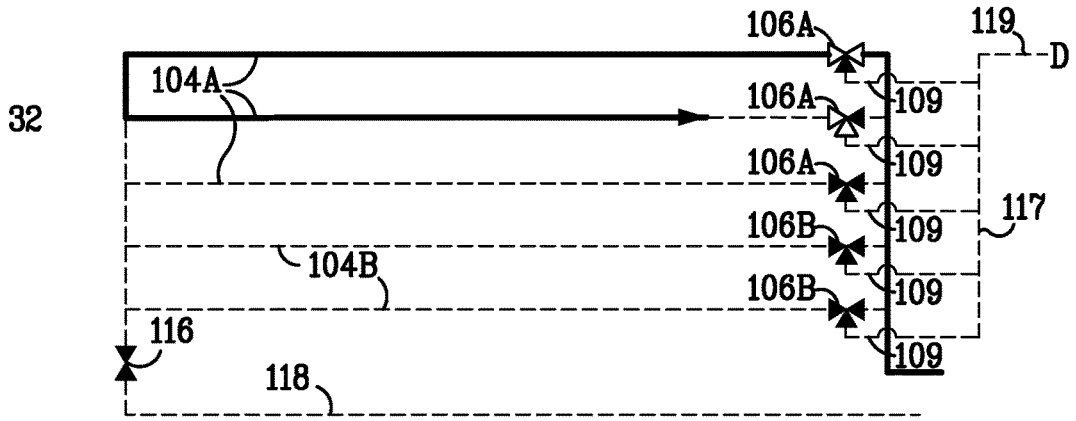
Figure 6C:
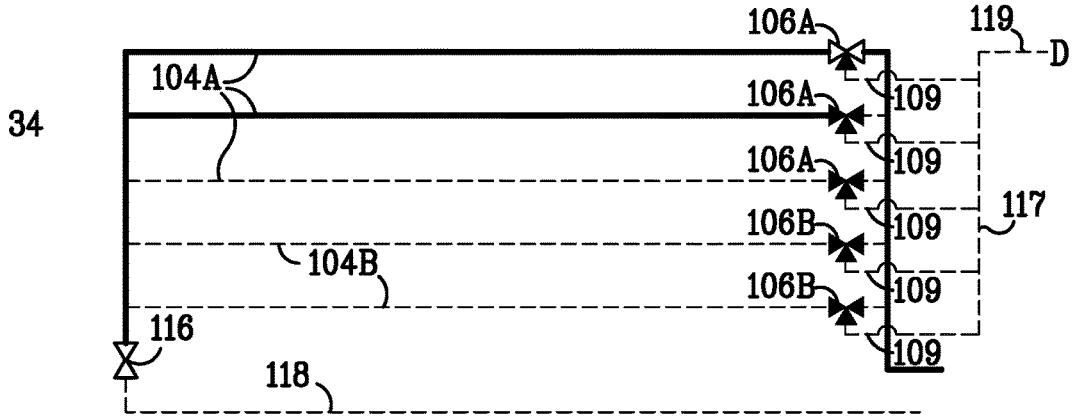
Figure 6D:
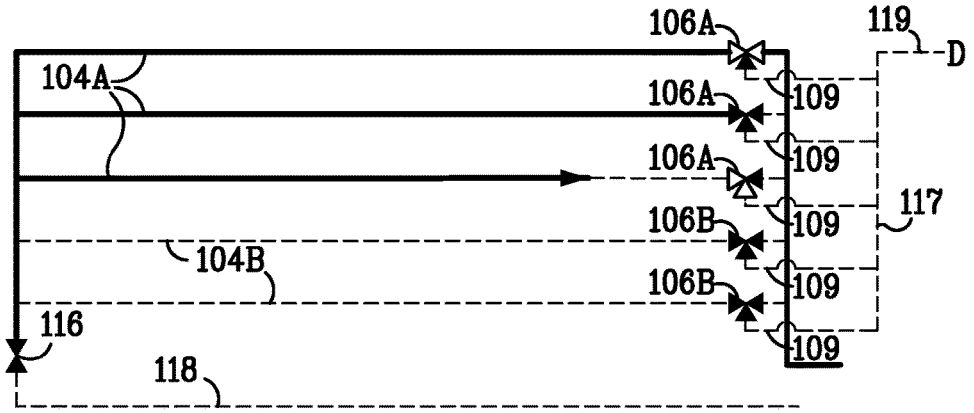
Figure 6E:
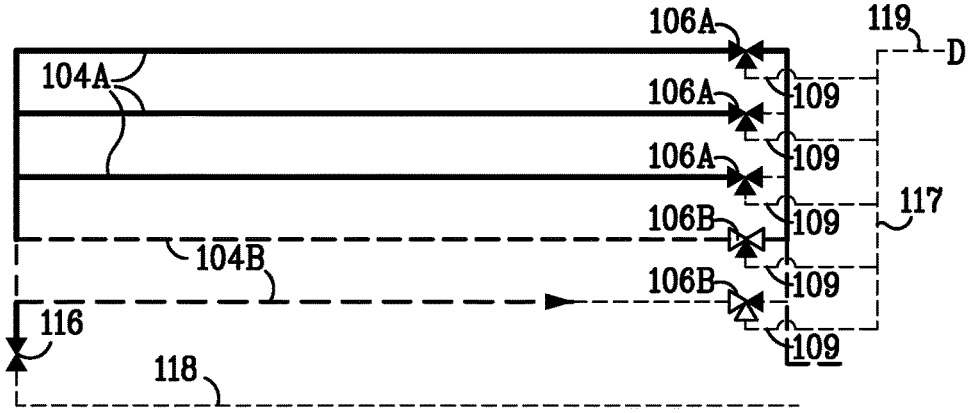
Figure 6F:
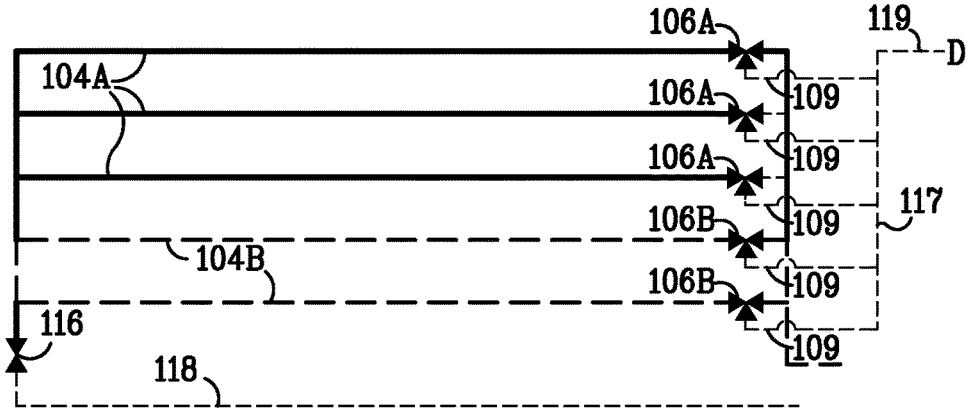

The operation was simulated in OLGA 7.2 multiphase flow simulation tool. FIG. 5 shows the simulated results of the surge rate of liquid accumulation to the separator from the production flow line during this seawater displacement operation. The maximum flow rate for brief periods of time in the first 3 hours of displacement is on the order of 170 $m^3$/hr (26 kbpd) during early stages of displacement. Then for the remaining 3½ hours, the flow rate steadies out to even unloading of the flow line, at the rate of seawater injection at 67 $m^3$/hr (10.1 kbpd).

Referring now to FIG. 5, simulation data on surge rate during the seawater displacement operation of this Example is shown. The horizontal axis is time from the start of seawater injection (in hours). The left vertical axis is the rate of arrival of liquid at the separator ($m^3$/hr). The right vertical axis is the rate of arrival of liquid at the separator (kbpd). Vertical lines in the graph represent event times: a=methanol injection, b=diesel injection, c=seawater injection, d=end of displacement.

Return to Operation Following Seawater Displacement:

Referring to FIG. 6A-6F, an example sequence for recharging the system for return to operations in the umbilical in preparation for restart is shown. At (30), the USLs (104A, 104B) (storage conduits) are charged with displacement fluid (e.g., seawater) after a displacement operation and the three-way inlet valves (106A, 106B) are fully closed. At (32), one of inlet valves (106A) is configured such that the USL is in fluid communication with the inlet manifold and one of the inlet valves (106A) is configured such that the USL is in fluid communication with the associated return flow line (109) and the USLs are substantially recharged (leaving a small volume between the inlet valve of the second USL and the inlet manifold that retains a small amount of displacement fluid) with treatment fluid (e.g., methanol) using a pump (not shown) in fluid communication with a source of treatment fluid (not shown). The return flow lines (109) may be sent to a drain manifold (117), which is in fluid communication with drain line (119). Configured in this manner, displacement fluid (e.g., seawater) from the USLs is pushed out to a drain (D) as the USLs refill. At (34), the inlet valve (106A) is fully closed and the subsea outlet valve (116) is opened to allow the displacement fluid to be pushed out of the outlet manifold. At (36), the subsea outlet valve (116) is closed and the final USL (104A) to be charged with treatment fluid is recharged by configuring the inlet valve (106A) of the final USL (104A) such that the USL is in fluid communication with the associated return flow line (109). The small, right-facing arrow indicates that displacement fluid (e.g., seawater) from the final USL recharging with treatment fluid is pushed out to a drain (D) via a return flow line as the final USL refills. Upon recharging the storage conduits with treatment fluid, the inlet valves (106A) are then fully closed (not shown). At (38), one of the inlet valves (106B) is configured such that the USL is in fluid communication with the inlet manifold and the other inlet valve (106B) is configured such that the USL is in fluid communication with the associated return flow line (109) and the USLs (104B) are recharged with the barrier fluid (e.g., diesel) using a pump (not shown) in fluid communication with a source of barrier fluid (not shown). As the USLs are recharged, displacement fluid in the USLs is pushed out to a drain (D) via the return flow line. At (40), the inlet valves (106B) of the USLs containing barrier fluid are fully closed and the system is substantially restored to its initial condition and is ready for re-use. The inlet manifold inlet valve may optionally be configured to receive displacement fluid to restart the process.

In other embodiments using a separate bypass valve configuration, the storage conduits may be similarly recharged as described using a multi-way inlet valve in the storage conduits, except the inlet valve of the associated storage conduit would be closed and the associated bypass valve located in the return flow line opened to provide fluid communication between the storage conduit and the return flow line. This recharging process may additionally include first reversing the configuration of the two storage conduits such that the displacement fluid between the inlet manifold and the junction of the return flow line with the storage conduit is first displaced.

In this Example, prior to returning to operation, 34 $m^3$ of methanol and 20 $m^3$ of diesel will need to be obtained to recharge the USLs. If an iceberg threat passes without compromise to integrity of the facility, the production flow line and umbilical may be returned to operation by the following sequence:

One of the methanol USLs on topsides is opened to the methanol pumps and another to the drain header and circulate methanol into the umbilical lines. Monitor for methanol and water at the drain. After 20 $m^3$ of methanol have been injected, monitor for methanol at the drain to determine if displacement is complete.

After methanol is detected at the drain, the return methanol umbilical line should be isolated. The subsea outlet valve proximate the outlet manifold should be opened and 4 $m^3$ of additional methanol should be pumped to ensure the water is swept out into the production flow line.

The USLs should be isolated from the production flow line by closing the subsea outlet valve proximate the outlet manifold, and the third methanol umbilical line (still full of seawater) should be opened to the drain. After another 10 $m^3$ of methanol is circulated and methanol is again detected at the drain, the methanol pump may be turned off and all methanol USL inlet valves closed.

Approximately 20 $m^3$ of diesel should be circulated through one diesel USL and returned through the second diesel USL to the drain header until diesel and no water is detected.

At this point in the operation, the umbilical charge is reset and the normal cold startup procedure may be applied.

The embodiments disclosed herein, as illustratively described and exemplified hereinabove, have several beneficial and advantageous aspects, characteristics, and features. The embodiments disclosed herein successfully address and overcome shortcomings and limitations, and widen the scope, of currently known teachings with respect to removing liquids from fluid handling systems. As used herein, hydrocarbon production systems may also include drilling operations.

It is believed that the disclosure set forth above encompasses multiple distinct inventions with independent utility. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements unless indicated otherwise.

INDUSTRIAL APPLICABILITY

The systems and methods disclosed herein are generally applicable to any fluid handling system, but are especially advantageous in the oil and gas industry.

It is believed that the following claims particularly point out certain combinations and subcombinations that are directed to one of the disclosed inventions and are novel and non-obvious. Inventions embodied in other combinations and subcombinations of features, functions, elements, and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

What is claimed is:

1. A system for displacing fluids from a fluid handling system that is comprised of at least one structure requiring displacement, the system for displacing fluids comprising:

i) a plurality of storage conduits, each storage conduit having an outlet and an inlet valve proximate an inlet;

ii) an outlet manifold having a plurality of inlets, one for each outlet of the plurality of storage conduits, and a manifold outlet spaced from the plurality of inlets;

iii) an outlet valve proximate the manifold outlet and connected to a flow line in fluid communication with an inlet of the at least one structure to be displaced;

iv) an inlet manifold having an inlet and a plurality of outlets, each of the plurality of outlets in fluid communication with an associated inlet valve of one of the plurality of storage conduits;

v) a displacement fluid inlet manifold inlet valve having an inlet in fluid communication with a source of a displacement fluid and an outlet in fluid communication with the inlet manifold;

vi) a treatment fluid inlet manifold inlet valve having an inlet in fluid communication with a source of a treatment fluid and an outlet in fluid communication with the inlet manifold;

vii) a barrier fluid inlet manifold inlet valve having an inlet in fluid communication with a source of a barrier fluid and an outlet in fluid communication with the inlet manifold; and viii) at least three drivers for transferring fluids into and out of the plurality of storage conduits and in fluid communication with the inlet manifold;

wherein the at least three drivers include a first driver to transfer displacement fluid, a second driver to transfer treatment fluid, and a third driver to transfer barrier fluid into the storage conduits to selective recharge the storage conduits.

2. The system of claim 1, wherein the system for displacing fluids is located remotely from a control facility and configured for remote operation from the control facility.

3. The system of claim 1, wherein at least one of the storage conduits is charged with a treatment fluid and at least one of the storage conduits is charged with a barrier fluid.

4. The system of claim 3, wherein the treatment fluid is for preventing or remediating hydrate formation and is selected from the group consisting of methanol, ethanol, ethylene glycol, diethylene glycol, triethylene glycol, and combinations thereof.

5. The system of claim 3, wherein the barrier fluid is selected from the group consisting of diesel, stabilized crude oil, nitrogen, argon, and combinations thereof.

6. The system of claim 1, wherein the displacement fluid is seawater and the source of the displacement fluid is an ocean.

7. The system of claim 1, wherein the at least one driver is a pump.

8. The system of claim 1, wherein the at least one driver is a compressor or a pressurized vessel.

9. The system of claim 1, wherein the system for displacing fluids is in fluid communication with, and used for displacing fluids from, a fluid handling system that is a hydrocarbon production system.

10. The system of claim 9, wherein the hydrocarbon production system is a subsea hydrocarbon production system.

11. The system of claim 10, wherein the at least one structure to be displaced is a production flow line including a riser.

12. A method for displacing fluids in a fluid handling system comprising at least one structure to be displaced and a plurality of storage conduits, the method comprising:

transferring a treatment fluid from at least one of the plurality of storage conduits towards or into the at least one structure to be displaced using at least one driver, while charging the storage conduit(s) from which the treatment fluid is transferred with displacement fluid;

transferring a barrier fluid from at least one of the plurality of storage conduits towards or into the at least one structure to be displaced using the at least one driver, while charging the storage conduit(s) from which the barrier fluid is transferred with displacement fluid; and transferring the displacement fluid from at least one of the plurality of storage conduits into the at least one structure to be displaced.

13. The method of claim 12, further comprising repeating the transfer of the treatment fluid from one or more additional storage conduits containing the treatment fluid until a desired volume of treatment fluid has been transferred out of the plurality of storage conduits or all of the plurality of storage conduits containing treatment fluid have been emptied.

14. The method of claim 12, further comprising repeating the transfer of the barrier fluid from one or more additional storage conduits containing the barrier fluid until a desired volume of barrier fluid has been transferred out of the plurality of storage conduits or all of the plurality of storage conduits containing barrier fluid have been emptied.

15. The method of claim 12, further comprising recharging the storage conduit(s) from which the treatment fluid was transferred with treatment fluid and recharging the storage conduit(s) from which the barrier fluid was transferred with barrier fluid.

16. A method for displacing active hydrocarbon fluids to shut-in a hydrocarbon production system comprising at least one structure to be displaced and a plurality of storage conduits, the method comprising:

transferring a treatment fluid from at least one of the plurality of storage conduits towards or into the at least one structure to be displaced using at least one driver, while charging the storage conduit from which the treatment fluid is transferred with displacement fluid;

transferring a barrier fluid from at least one of the plurality of storage conduits towards or into the at least one structure to be displaced using the at least one driver, while charging the storage conduit from which the barrier fluid is transferred with displacement fluid; and transferring the displacement fluid from at least one of the plurality of storage conduits into the at least one structure to be displaced.

17. The method of claim 16, further comprising repeating the transfer of the treatment fluid from one or more additional storage conduits containing the treatment fluid until a desired volume of treatment fluid has been transferred from the plurality of storage conduits or all of the plurality of storage conduits containing treatment fluid have been emptied.

18. The method of claim 16, further comprising repeating the transfer of the barrier fluid from one or more additional storage conduits containing the barrier fluid until a desired volume of barrier fluid has been transferred from the plurality of storage conduits or all of the plurality of storage conduits containing barrier fluid have been emptied.

19. The method of claim 16, further comprising recharging the storage conduit(s) from which the treatment fluid was transferred with treatment fluid and recharging the storage conduit(s) from which the barrier fluid was transferred with barrier fluid.

* * * * *